US006960711B2

(12) United States Patent
Huang

(10) Patent No.: US 6,960,711 B2
(45) Date of Patent: Nov. 1, 2005

(54) INVENTIVE STRUCTURE OF SPRING DRIVING MUSICAL MOVEMENT REDUCTION DEVICE

(75) Inventor: Lung-Hsi Huang, Dali (TW)

(73) Assignee: Kyooh Precision Industry Co., Ltd., Taichung Hsien (TW)

( * ) Notice: Subject to any disclaimer, the term of this patent is extended or adjusted under 35 U.S.C. 154(b) by 77 days.

(21) Appl. No.: 10/724,433

(22) Filed: Nov. 28, 2003

(65) Prior Publication Data

US 2005/0115380 A1 Jun. 2, 2005

(51) Int. Cl.[7] ..... G10F 1/06
(52) U.S. Cl. ..... 84/95.1; 84/95.2; 84/94.1; 84/94.2; 84/96
(58) Field of Search ..... 84/95.1, 95.2, 84/94.1, 94.2, 96

(56) References Cited

U.S. PATENT DOCUMENTS 4,557,173 A * 12/1985 Isaka ..... 84/95.1
5,543,577 A * 8/1996 Zhu et al. ..... 84/95.2
5,700,963 A * 12/1997 Koelemeijer et al. ..... 84/95.1
6,323,404 B1 * 11/2001 Hayashi ..... 84/94.1

* cited by examiner

*Primary Examiner*—Shih-Yung Hsieh
(74) *Attorney, Agent, or Firm*—Apex Juris, pllc; Tracy M Heims

(57) ABSTRACT

An inventive structure of the reduction device of the spring driving musical movement comprises a musical movement base, a gear fixed base, a step spur gear, a bilateral gear and a friction unit; wherein the gear fixed base, formed from project plastic material, installs with a locating hole, two parallel concave grooves and a right-side bilateral gear installing groove thereon; and rivets with the musical movement base in a fixed position by the locating hole. After said step spur gear separately parallelizes in said parallel concave groove, said right-side bilateral gear installing groove and a left-side bilateral gear installing groove on the musical movement base were separately installed with a bilateral gear. And said friction unit locates on the musical movement base to make a worm thereon mutually and vertically engages with a left-side gear of the bilateral gear, to become a spring driving musical movement reduction device.

3 Claims, 4 Drawing Sheets

INVENTIVE STRUCTURE OF SPRING DRIVING MUSICAL MOVEMENT REDUCTION DEVICE

BACKGROUND OF THE INVENTION

1. Field of the Invention

This invention relates to an inventive structure of spring driving musical movement reduction device, and in particular, to a gear fixed base formed from project plastic material of a spring driving musical movement reduction device; the inventive structure uses the plastic elasticity to make the musical movement moving more stable, to reduce noise, to rise production efficiency and the quality of the musical movement.

2. Description of the Prior Art

Referring to FIG. 1 and FIG. 1(A), the characters of the prior art gear fixed device of the spring driving musical movement reduction device are: installing a friction unit 12, a bilateral gear 13 in a support frame set 11 made by punching an iron plate therein, and parallelizing a step spur gear 14 in a shaft bracket 15 of said support frame set 11, then riveting said shaft bracket 15; the material of said support frame set 11 is iron, and the collocated step spur gear 14 is made with project plastic material; the main composed disadvantages are:

(1) The ironed support frame set 11 easily produces featheredges upon pouching, which effects the movement of said bilateral gear 13 and said step spur gear 14, also accelerates the attrition of each gear;

(2) Said support frame set 11 also easily becomes deformed during the electroplating progress, which makes the step spur gear 14 hard to be installed and cause noise upon moving;

(3) To avoid the step spur gear 14 slip, the shaft bracket 15 needs to be riveted through quadratic process, however the shaft bracket 15 easily causes variable due to over pressing to make the step spur gear 14 rotate not smooth or even could not rotate, which causes whole structure produce disadvantages.

With respect the prior art gear fixed device of the spring driving musical movement reduction device, please also refer to the structure showing as FIG. 2 and FIG. 2(A), which parallelizes a step spur gear 21, a friction unit 22 and a bilateral gear 23 in a gear concave groove of a musical movement base 21, and covers up a plastic spring cover 25 to make an extension portion 26 and another extension portion 27 of said spring cover 25 mutually cooperate to press a step spur gear 21; however, the main composed disadvantages are:

(1) The step spur gear 21 could not be effectively pressed due to the spring cover 25 deformed, which effects said step spur gear 21 move regularly.

(2) To fix the step spur gear 21 needs to use an extension portion 28 of the spring cover 25 to rivet and fix, however, the extension portion 28 often becomes deformed due to very complicated shape to cause pressing default.

This shows, there still exits many defaults in manufacturing components, fabricating process and the quality after fabricating about the prior art structure of the gear fixed device of the spring driving musical movement reduction device; accordingly, the above-described prior art structure is not a perfect design and has still many disadvantages to be solved.

The inventor has noticed the various disadvantages associated with the conventional structure of the spring driving musical movement reduction device and thought to improve it, and after having carried out an intensive study for many years, has successfully developed the inventive structure of the spring driving musical movement reduction device.

SUMMARY OF THE INVENTION

It is an object of the present invention to provide an inventive structure of the spring driving musical movement reduction device, to improve the defaults and choke points in the prime cost and quality of the conventional structure of the spring driving musical movement reduction device; to make production lines fabricate speedy and conveniently, to rise the industry quality of the musical movement, to effectively rise the production efficiency, and to make the spring driving movement more practical and popular.

A second object of the present invention is to provide an inventive structure of the spring driving musical movement reduction device to make the play speed of the spring driving movement more stable, to reduce the noise upon gear rotating on play, and to rise the quality of the musical movement.

Another object of the invention is to provide an inventive structure of the spring driving musical movement reduction device to reduce the probability of deforming and causing the featheredges upon manufacturing the gear fixed base, to raise the probability of producing quality products upon producing the spring driving musical movements, and to effectively reduce the production costs.

The inventive structure of the reduction device of the spring driving musical movement to achieve the above invention purposes comprises: a musical movement base, a gear fixed base, a step spur gear, a bilateral gear and a friction unit; wherein a musical movement base, having a locating frame, a locating post and a left-side bilateral gear installing groove thereon, combines with a gear fixed base by said locating frame and said locating post, and uses said left-side bilateral gear installing groove to cover a friction unit;

a gear fixed base, formed from project plastic material, installs with a locating hole, two parallel concave grooves and a right-side bilateral gear installing groove; and the base shape of said gear fixed base just could installs in the locating frame on the musical movement base, and said locating hole in the middle of said gear fixed base tightly combines and fixes position with the locating post on the musical movement base after said locating post inserts therein; and a curve flange, setting on the entrance of each parallel concave groove, parallelizes in a step spur gear; and said right-side bilateral gear installing groove cooperates with the left-side bilateral gear installing groove on the musical base to be installed in a bilateral gear; and a friction unit locates on the musical movement base to make a worm thereon mutually and vertically engages with a left-side gear of the bilateral gear.

BRIEF DESCRIPTION OF THE DRAWINGS

The drawings disclose an illustrative embodiment of the present invention, which serves to exemplify the various advantages and objects hereof, and are as follows.

DETAILED DESCRIPTION OF PREFERRED EMBODIMENT

Figure 3:
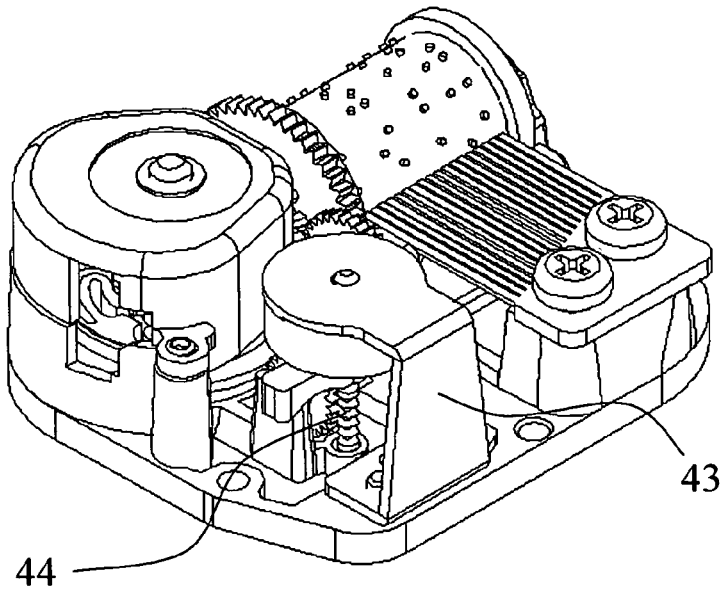
FIG. 3 is an outward three-dimensional diagram of the composition of the spring driving musical movement reduction device according to the present invention.
Figure 3A:
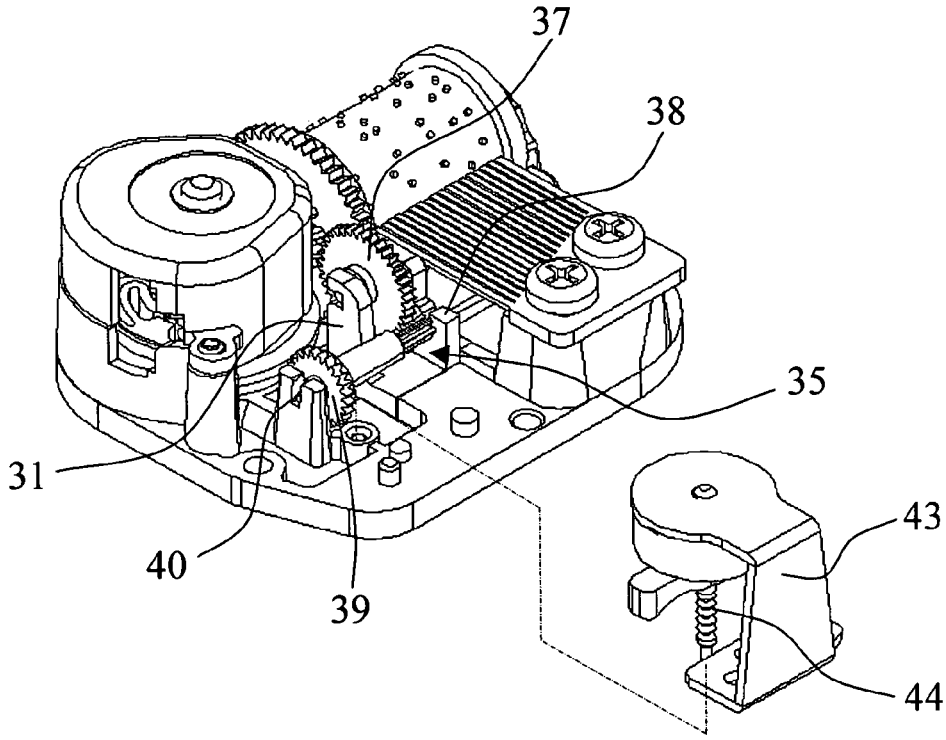
FIG. 3(A) is a three-dimensional diagram of the gear fixed base structure of the spring driving musical movement reduction device according to the present invention.
Figure 3B:
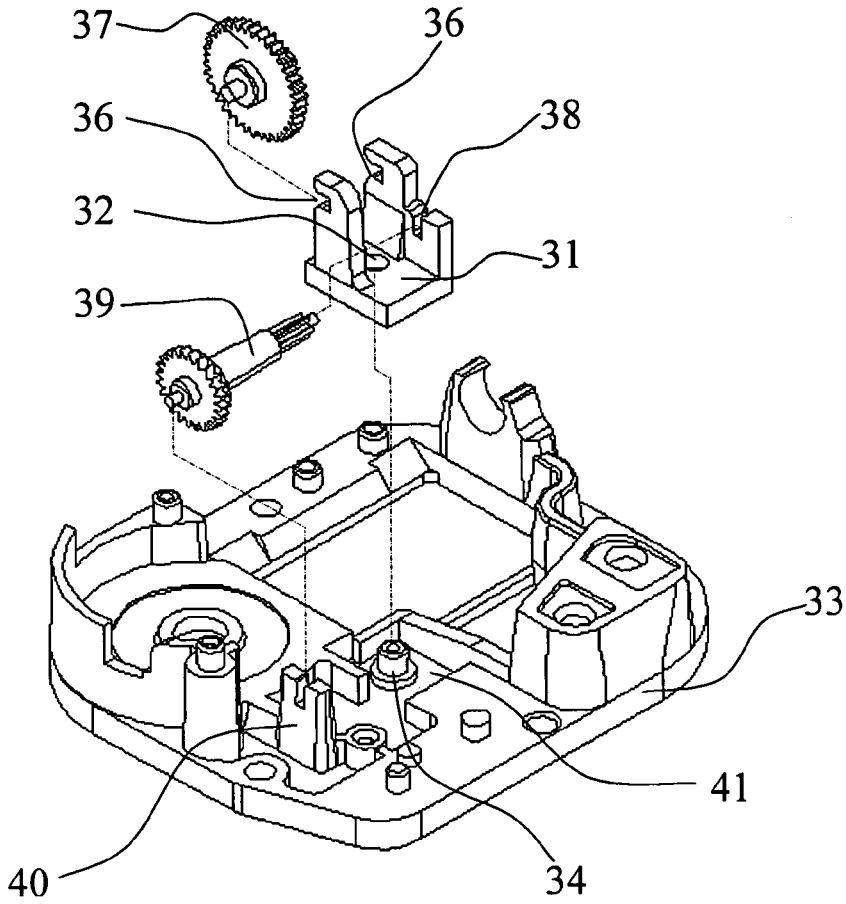
FIG. 3(B) is a separated three-dimensional diagram of the gear fixed base of the spring driving musical movement reduction device according to the present invention.
Figure 3C:
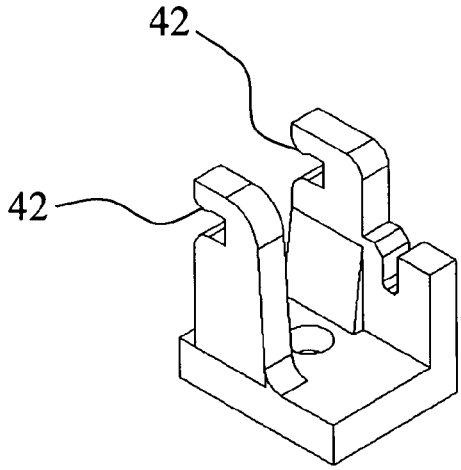
FIG. 3(C) is a enlarged, separated three-dimensional diagram of the gear fixed base of the spring driving musical movement reduction device according to the present invention.

Referring to FIG. 3, an inventive structure of the spring driving musical movement reduction device according to the present invention comprises: a musical movement base 33, a gear fixed base 31, a step spur gear 37, a bilateral gear 39 and a friction unit 43.

A musical movement base 33 installs a left-side bilateral gear installing groove 40, a locating frame 41 and a locating post 34, said locating post 34 rivets and combines with a locating hole 32 on a gear fixed base 31;

a gear fixed base 31, formed from project plastic material, installs two parallel concave grooves 36, a locating hole 32 and a right-side bilateral gear installing groove 38 thereon; wherein said two parallel concave grooves 36, installing on the front end of said gear fixed base 31, set a curve flange 42 on each entrance to make the widths of two parallel concave grooves 36 smaller than the shaft diameter of a step spur gear 37, and using the elasticity and smooth of project plastic could make said step spur gear 37 insert parallel to said two parallel concave grooves 36 therein, after inserting in, said step spur gear 37 still could 360° rotate inside said two parallel concave grooves 36, and said step spur gear 37 would not fall down due to the curve flange 42 installing on the entrances of two parallel concave grooves 36, the locating hole 32 on said fixed base 31 rivets and combines with the locating post 34 on the musical movement base 33; furthermore, said right-side bilateral gear installing groove 38 collocates with the left-side bilateral gear installing groove 40 of the musical to install a bilateral gear 39 therein, then fixing the friction 43 on the musical movement base 33 makes a worm 44 of the friction unit 43 engage with left-side gear of the bilateral gear 39 mutually, and then to become a spring driving musical movement reduction device 35.

The detailed specifications of the combining process about the structure of a spring driving musical movement reduction device according to the present invention are as follows:

the gear fixed base 31 has been installed inside the locating frame 41 of the musical movement base 33 in a fixed direction, the locating hole 32 on said fixed base 31 rivets and combines with the locating post 34 on the musical movement base 33, and to make the gear fixed base 31 tightly locate and combine with the musical movement base 33; the bilateral gear 39 has been separately installed inside left-side bilateral gear installing groove 40 of the musical movement base 33 and the right-side bilateral gear installing groove 38 of the gear fixed base, the friction unit 43 has been located on the musical movement base 33 to make a worm of said friction unit 43 vertically and mutually engage with the left-side bilateral gear of said bilateral gear 39, to make the reduction device of an inventive structure of a spring driving musical movement according to the present invention, to make the combining process of the present invention become simple, easy and quick.

Comparing the reduction device structure of a spring driving musical movement of the present invention with the other prior arts, the present invention has advantages as follows:

(1) the fixed base formed from project plastic material collocates with the step spur gear formed from the same material as said fixed base, to fabricate more conveniently and quickly, to make the step spur gear rotate more smoothly and fluently, and the rotation interference caused from different materials would not effect the pace making function, without causing noise and to rise the produce quality of the musical movement.

Figure 1A:
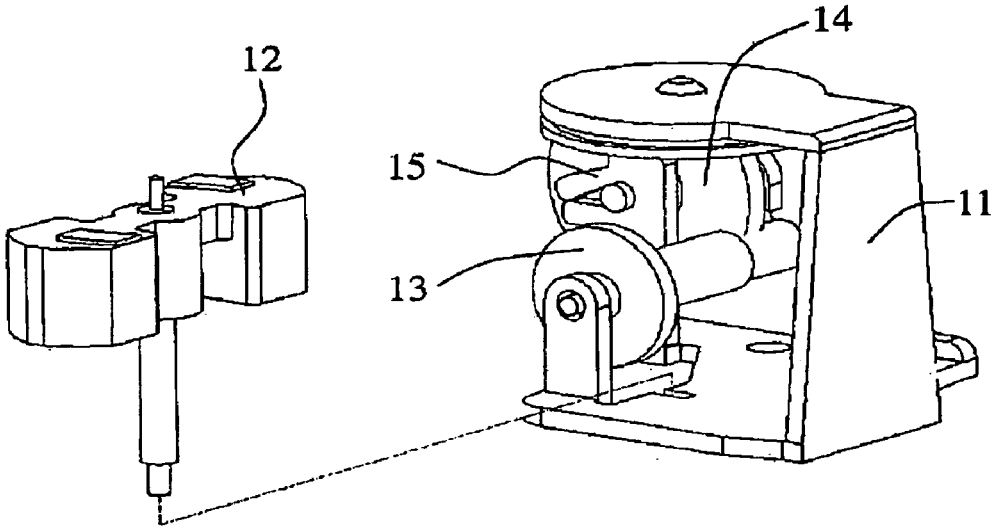
FIG. 1(A) (Prior Art)
FIG. 1(A) is a three-dimensional diagram of the prior art structure of the spring driving musical movement reduction device.
Figure 1:
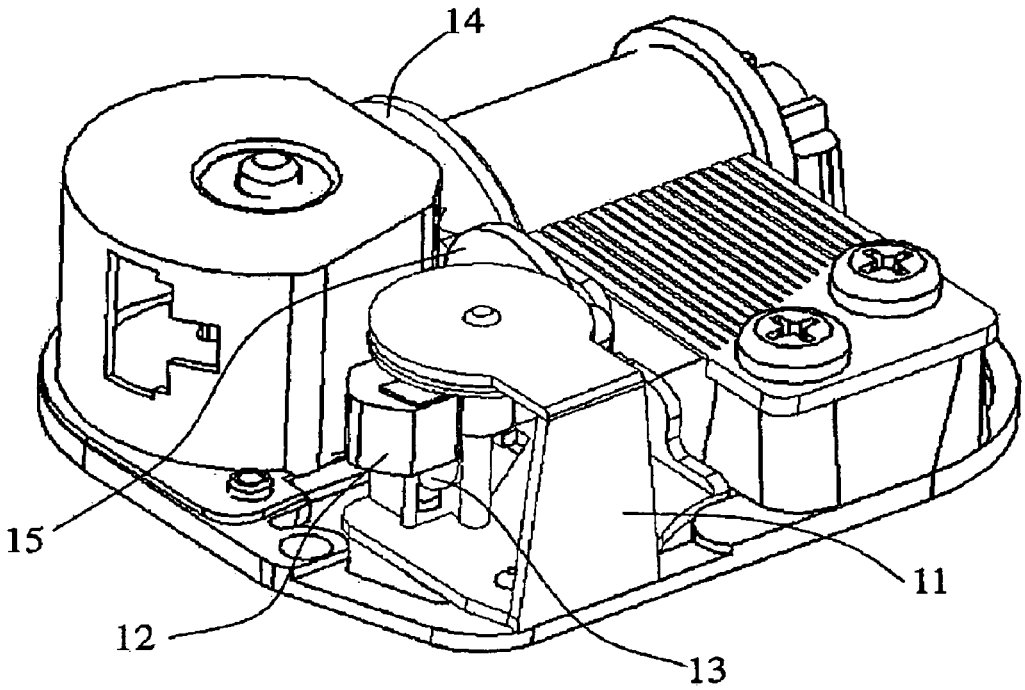
FIG. 1 (Prior Art)
FIG. 1 is a three-dimensional diagram of the prior art structure of the spring driving musical movement.
Figure 2A:
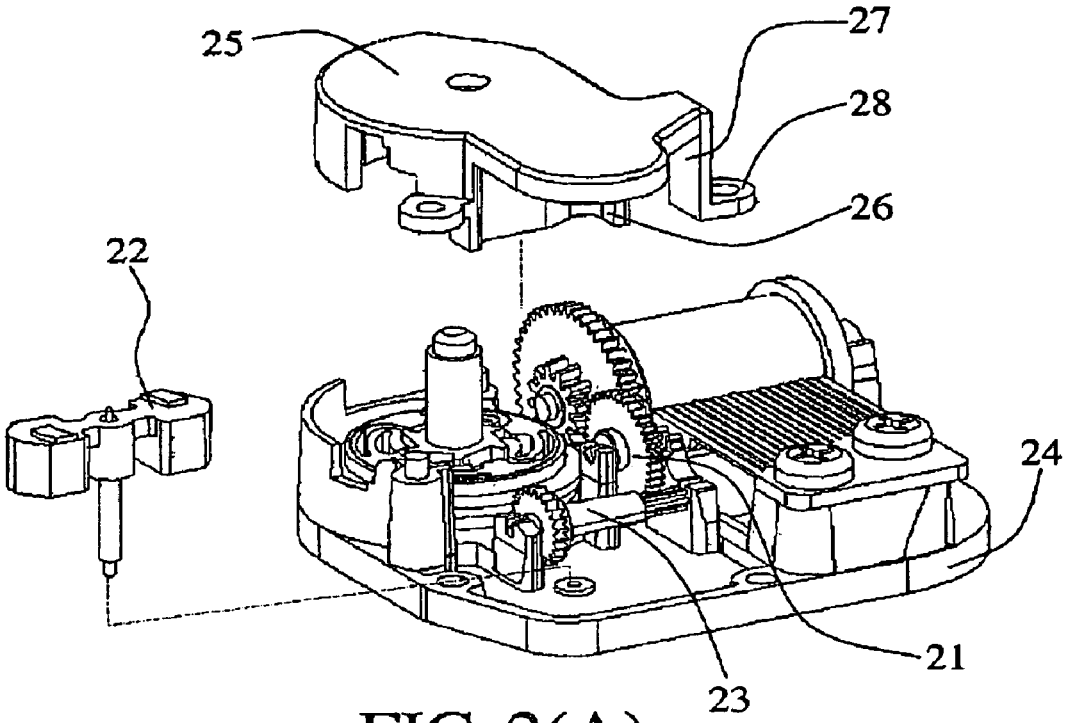
FIG. 2(A) (Prior Art)
FIG. 2(A) is a separated three-dimensional diagram of the prior art structure of the gear fixed base of the spring driving musical movement reduction device.
Figure 2:
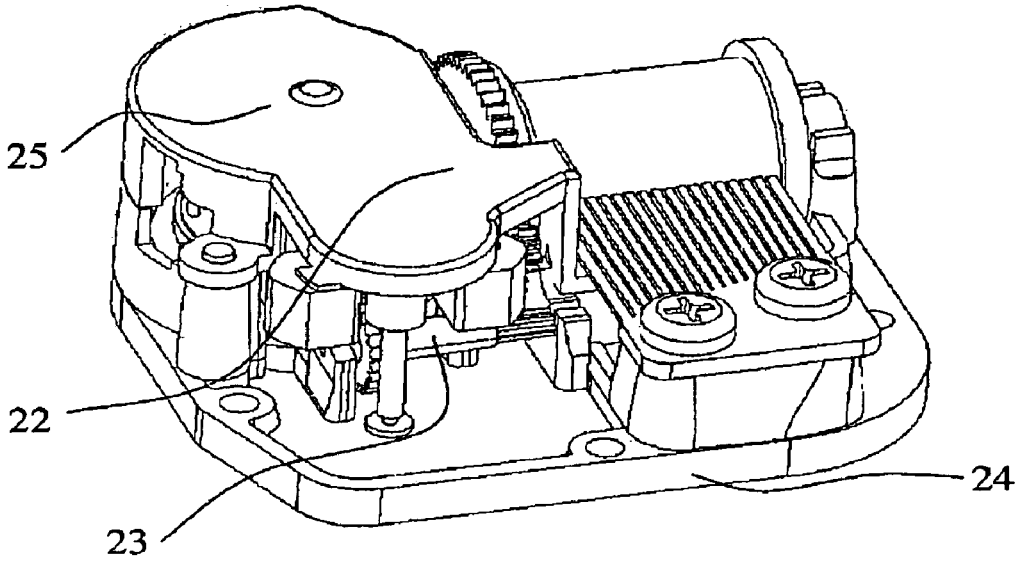
FIG. 2 (Prior Art)
FIG. 2 is a three-dimensional diagram of the prior art structure of the spring driving musical movement.

(2) two curve flanges respectively install on the entrances of two parallel concave grooves on the gear fixed base of the present invention, to avoid further proceeding the riveted operation of the step spur gear as described in prior art FIG. 1, to save the work time and prime cost of second process; at the same time, to avoid causing the step gear been bad pressed due to the spring cover extension portion easily deformed, and to reduce the lose upon fabricating and producing.

Many changes and modifications in the above described embodiment of the invention can, of course, be carried out without departing from the scope thereof. Accordingly, to promote the progress in science and useful arts, the invention is disclosed and is intended to be limited only by the scope of the appended claims.

What is claimed is:

1. A reduction device structure of a spring driving musical movement, which comprises: a musical movement base, a gear fixed base, a step spur gear, a bilateral gear and a friction unit; wherein a musical movement base, having a locating frame, a locating post and a left-side bilateral gear installing groove thereon, combines with a gear fixed base by said locating frame and said locating post, and uses said left-side bilateral gear installing groove to cover a friction unit;

a gear fixed base, formed from project plastic material, installs with a locating hole, two parallel concave grooves and a right-side bilateral gear installing groove; and the base shape of said gear fixed base installs in the locating frame on the musical movement base, and said locating hole in the middle of said gear fixed base tightly combines and fixes position with the locating post on the musical movement base after said locating post inserts therein; and a curve flange, setting on the entrance of each parallel concave groove, parallelizes in a step spur gear; and said right-side bilateral gear installing groove cooperates with the left-side bilateral gear installing groove on the musical base to be installed in a bilateral gear; and a friction unit locating on the musical movement base to make a worm thereon mutually and vertically engages with a left-side gear of the bilateral gear.

2. The reduction device structure of a spring driving musical movement according to claim 1, wherein said curve flange sets on each entrance of said two parallel concave grooves on the front end of said gear fixed base, to make the widths of two parallel concave grooves smaller than the shaft diameter of a step spur gear.

3. The reduction device structure of a spring driving musical movement according to claim 1, wherein said step spur gear parallelizes in said gear fixed base to prevent fall down easily upon fabricating process.

* * * * *